US008767794B2

(12) United States Patent
Cho et al.

(10) Patent No.: US 8,767,794 B2
(45) Date of Patent: Jul. 1, 2014

(54) LOW TEMPERATURE MELTING FURNACE AND METAL SECTOR USING AN EXTERNAL COOLING PASSAGE

(75) Inventors: Hyun Je Cho, Daejeon (KR); Deuk Man Kim, Daejeon (KR); Seok Mo Choi, Daejeon (KR); Cheon Woo Kim, Daejeon (KR); Jung Kwon Son, Daejeon (KR); Tae Won Hwang, Daejeon (KR)

(73) Assignee: Korea Hydro & Nuclear Power Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 13/468,152

(22) Filed: May 10, 2012

(65) Prior Publication Data

US 2013/0208757 A1 Aug. 15, 2013

(30) Foreign Application Priority Data

Feb. 14, 2012 (KR) ..... 10-2012-0014738

(51) Int. Cl.
*H05B 6/62* (2006.01)

(52) U.S. Cl.
USPC ..... 373/158; 373/156

(58) Field of Classification Search
USPC ..... 373/158, 151, 154, 155, 156, 165, 71, 373/72, 75, 76, 113; 165/171, 183, 297, 165/101, 169, 168, 170, 172, 173, 174, 165/176; 266/241, 193, 194, 100; 432/77, 432/238; 75/10.14, 10.18; 122/6 A, 235.11, 122/235.12, 295, 300, DIG. 13, 4 C, 9
See application file for complete search history.

(56) References Cited

U.S. PATENT DOCUMENTS

| | | | | | |
|---|---|---|---|---|---|
| 4,432,093 | A * | 2/1984 | Reboux | ..... | 373/157 |
| 4,923,508 | A * | 5/1990 | Diehm et al. | ..... | 373/163 |
| 5,889,813 | A * | 3/1999 | Fujita et al. | ..... | 373/156 |
| 2005/0129087 | A1 * | 6/2005 | Brun et al. | ..... | 373/155 |

FOREIGN PATENT DOCUMENTS

| | | | |
|---|---|---|---|
| EP | 0056915 | A1 | 4/1982 |
| EP | 0835043 | A1 | 4/1998 |
| JP | 7-028957 | U | 5/1995 |
| JP | 11-074070 | A | 3/1999 |
| JP | 2000-258067 | A | 9/2000 |
| JP | 2005-517148 | A | 6/2005 |

* cited by examiner

*Primary Examiner* — Henry Yuen
*Assistant Examiner* — Hung D Nguyen
(74) *Attorney, Agent, or Firm* — Rabin & Berdo, P.C.

(57) ABSTRACT

A low temperature melting furnace using an external cooling passage includes a wall including a plurality of metal sectors, each metal sector including a cooling passage formed along a longitudinal direction thereof, and an extension tube provided outwardly from the wall and connected to the cooling passage.

5 Claims, 4 Drawing Sheets

LOW TEMPERATURE MELTING FURNACE AND METAL SECTOR USING AN EXTERNAL COOLING PASSAGE

PRIORITY

This application claims the benefit under 35 U S. C. §119 a of a Korean patent application filed in the Korean Intellectual Property Office on Feb. 14, 2012 and assigned Serial No. 10-2012-0014738, and the entire disclosure of which is hereby incorporated by reference.

BACKGROUND OF THE INVENTION

1. Field of the Invention

The present invention relates to a low temperature melting furnace using an external cooling passage and a metal sector, and more particularly, to a low temperature melting furnace using an external cooling passage and a metal sector in which an extension tube is provided to the metal sector to reduce heat caused by inductive current so that the metal sector may have a decreased thickness and thus a plurality of metal sectors may be provided in the low temperature melting furnace, thereby reducing an influence of the inductive current to improve energy efficiency.

2. Description of the Related Art

In a nuclear power plant, a protective clothing, PVC, vinyl sheet, waste, waste ion exchange resin, boric acid waste, slurry and a dried material that are produced during operation and maintenance of the nuclear power plant are placed altogether in a melting furnace that uses inductive current heating such that verified waste is generated to minimize an environmental impact as well as emission of a radioactive waste drum is reduced.

In addition, a vitrification technology is used to stabilize waste such as liquid waste or dry waste produced during retreatment of spent nuclear fuel.

Generally, the melting furnace is an apparatus used for vitrificating waste contained within the melting furnace.

Prior art documents include, for example, Korean Patent No. 10-0470730, titled "Smelting Incineration Apparatus and Method of Solid Waste Treatment," Korean Patent Publication No. 10-2004-0010397, titled "Tapping Device of Melting Furnace and Molten Metal Heating Device," and Korean Patent No. 10-1006751, titled "Core-Type Furnace."

In the above prior art documents, a metal sector is provided to lower heat generated by inductive current transmitted from a high frequency generator to the melting furnace.

However, in a conventional metal sector of the melting furnace, an inlet and an outlet are required to allow a cooling water to flow in and out, and thus, the metal sector needs to have an increased area.

Also, since the metal sector has an increased area, space utilization as well as the influence of the inductive current is lowered, thereby reducing energy efficiency of the metal sector.

SUMMARY OF THE INVENTION

Accordingly, the present invention has been made in view of the above problems, and the present invention is to provide a low temperature melting furnace using an external cooling passage and a metal sector, in which a limitation to a size of a cross section of the metal sector required to secure a cooling passage within the metal sector is minimized and a cooling water flow is improved, in a cooling structure for cooling a wall of the low temperature melting furnace comprising a plurality of metal sectors.

In one aspect of the present invention, a low temperature melting furnace using an external cooling passage includes a wall including a plurality of metal sectors, each metal sector including a cooling passage formed along a longitudinal direction thereof, and an extension tube provided outwardly from the wall and connected to the cooling passage.

In one embodiment, the metal sector is preferably supported by a support unit having a plate shape and the support unit preferably has a number corresponding to a number of the metal sector.

In one embodiment, the extension number preferably has a number corresponding to a number of the metal sector and the extension tube is preferably connected to only the cooling passage of one metal sector.

In one embodiment, a metal sector of a low temperature melting furnace using an external cooling passage preferably includes a cooling passage formed along a longitudinal direction of the metal sector, the cooling passage being connected to an extension tube provided outwardly from the wall.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Exemplary embodiments of the present invention will be described herein below with reference to the accompanying drawings.

Figure 1:
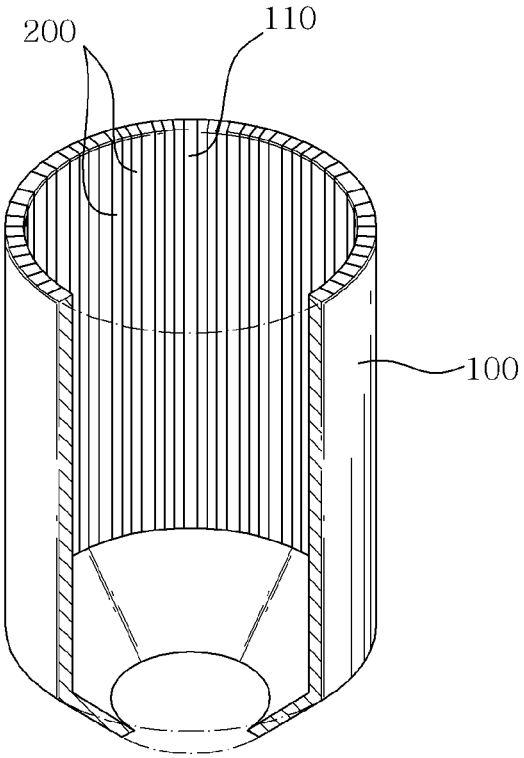
FIG. 1 is a perspective view illustrating a low temperature melting furnace using an external cooling passage in which a metal sector is provided according to the present invention.
Figure 2:
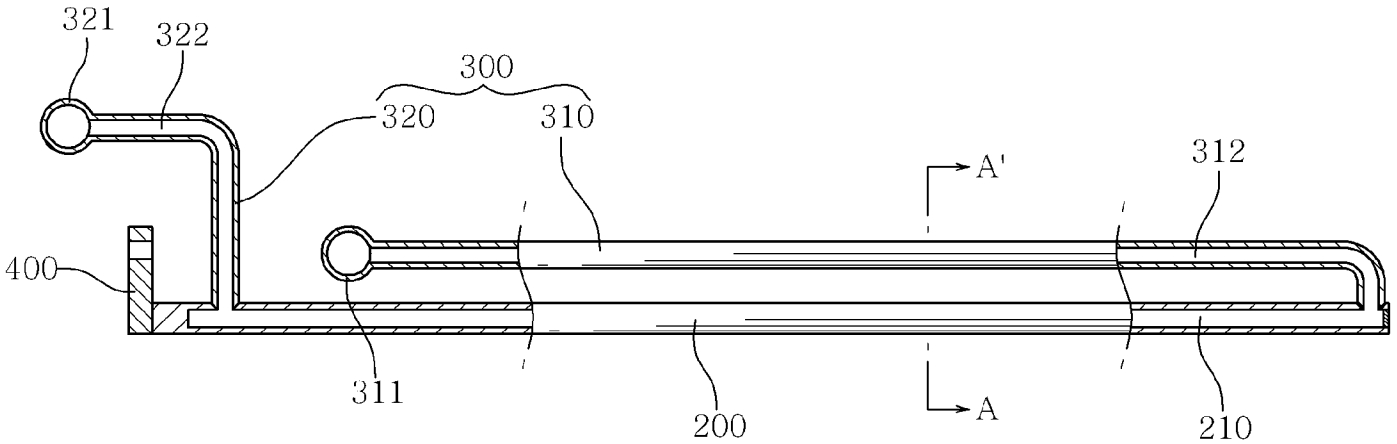
FIG. 2 is a front view illustrating an extension tube provided in a metal sector according to the present invention.
Figure 3:
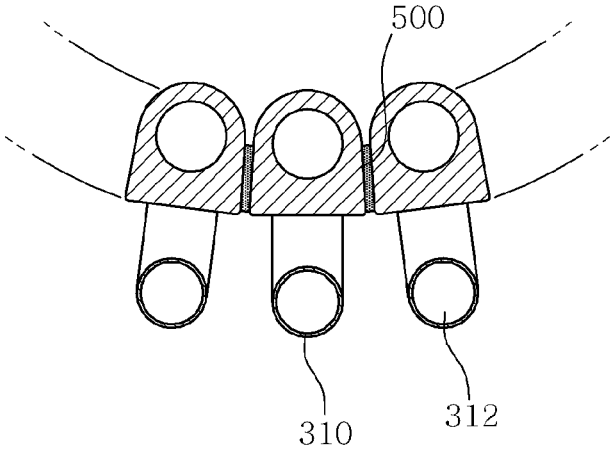
FIG. 3 is a cross sectional view taken along line A-A' of FIG. 2.
Figure 4:
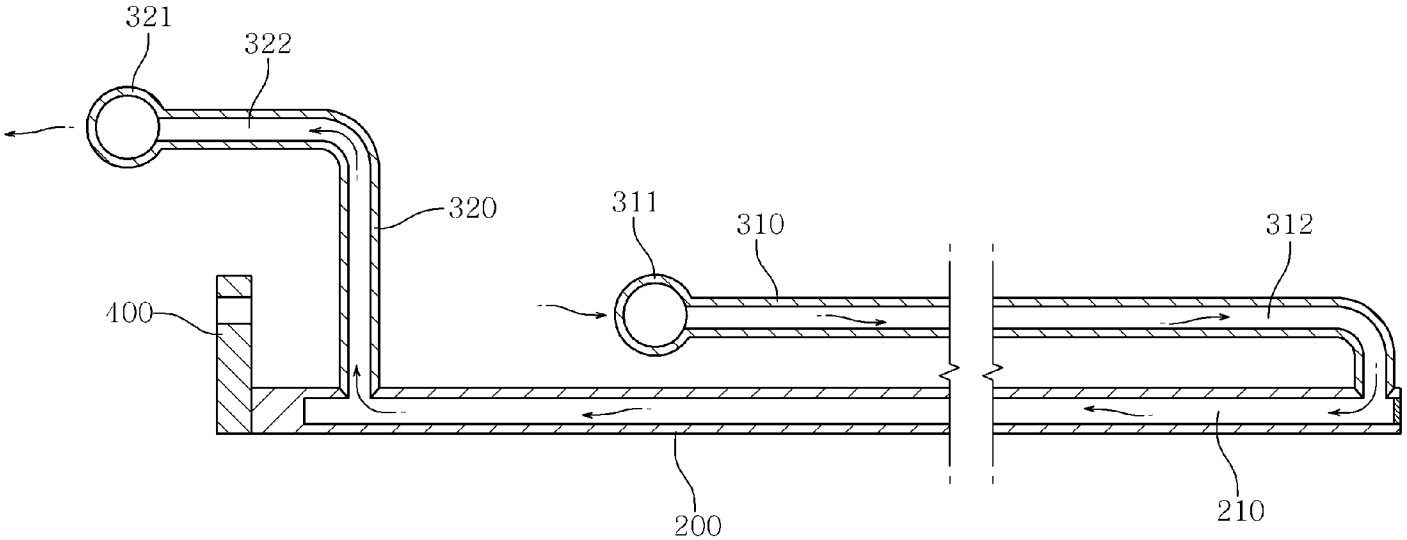
FIG. 4 is a cross sectional view illustrating circulation of a cooling water between a metal sector and an extension tube according to the present invention.

In a low temperature melting furnace using an external cooling passage according to the present invention, a plurality of metal sectors are used to form a wall of the low temperature melting furnace, as shown in FIG. 1, an extension tube is provided to the metal sector, as shown in FIG. 2, the metal sector is supported by a support unit, as shown in FIG. 3, and a cooling water is circulated when the metal sector is provided with the extension tube, as shown in FIG. 4.

As shown in FIG. 1, the low temperature melting furnace using the external cooling passage includes a low temperature melting furnace 100 and a metal sector 200.

The low temperature melting furnace 100 is formed in a cylindrical shape and contains radioactive and non-radioactive waste therein.

Specifically, the low temperature melting furnace 100 includes a container for containing the waste to be melted and a cover for sealing the contained waste.

The low temperature melting furnace 100 includes a wall 110 comprising a plurality of metal sectors 200.

As shown in FIGS. 2 and 3, the metal sector 200 is formed in a shape of a pipe that is closed at both ends and is elongated along a longitudinal direction of the low temperature melting furnace 100.

The metal sector 200 may comprise, for example, stainless steel and a cooling passage 210 is formed therein along a longitudinal direction.

The cooling passage 210 is provided with an extension tube 300 connected to the cooling passage 210, which is provided outwardly from the wall 110.

The extension tube 300 has a number corresponding to the number of the metal sector 200 and is connected only to the cooling passage 210 of each of the metal sector 200.

The extension tube 300 includes a first extension tube 310 and a second extension tube 320 and the first extension tube 310 is connected to one end of the metal sector 200 and the second extension tube 320 is connected to the other end of the metal sector 200.

The first extension tube 310 is connected to the metal sector 200, wherein one end portion of the first extension tube 310 which is connected to the metal sector 200 is curved to be perpendicular to the first extension tube 310 and the other end portion thereof has an inlet 311 that is extended therefrom and formed in a circular shape.

A cooling water supplied through the inlet 311 flows to the cooling passage 210 of the metal sector 200 through the first extension tube 310.

Specifically, a first cooling passage 312 is formed in the first extension tube 310 and the cooling water supplied through the inlet 311 of the first extension tube 310 flows to the first cooling passage 312 to flow to the cooling passage 210 of the metal sector 200.

In the second extension tube 320, similar to the first extension tube 310, one end portion of the second extension tube 320 which is connected to the metal sector 200 is curved to be perpendicular to the second extension tube 320 and the other end portion thereof has an outlet 321 that is extended therefrom and formed in a circular shape.

A cooling water supplied to the cooling passage 210 of the metal sector 200 flows to the second extension tube 320 connected to the cooling passage 210 of the metal sector 200.

Specifically, a second cooling passage 322 is formed in the second extension tube 320 and a cooling water supplied from the metal sector 200 flows to the second cooling passage 322 to be discharged outside through the outlet 321 of the second extension tube 320.

Accordingly, the cooling water may easily flows in and out through the extension tube 300, thereby enabling efficient circulating of the cooling water.

The metal sector 200 is supported by a support unit 400 in a plate shape.

The metal sector 200 is positioned below the support unit 400, which has a number corresponding to the number of the metal sector 200.

An insulation material 500 is used to fill between the metal sectors 200, wherein the insulation material 500 comprises ceramic that has good physical, chemical and thermal stability, thereby avoiding electrical arc to minimize electrical damage.

As shown in FIG. 4, in the first extension tube 310, the cooling water flowing through the inlet 311 is supplied to the metal sector 200.

Specifically, the cooling water flowing through the inlet 311 flows to the first cooling passage 312 of the first extension tube 310 to be supplied to the cooling passage 210 of the metal sector 200.

The cooling water supplied to the cooling passage 210 flows to the second cooling tube 320.

Specifically, the cooling water supplied to the cooling passage 210 of the metal sector 200 flows to the second cooling passage 322 that is formed within the second extension tube 320 to be discharged outside through the outlet 321 of the second extension tube 320.

Accordingly, by using the extension tube 300, the cooling water is supplied and circulated within the metal sector 200 to cool the low temperature melting furnace 100.

A condition of use and an operation of the low temperature melting furnace using the external cooling passage and the metal sector that is configured as described above according to the present invention are described below.

First, as shown in FIGS. 1 and 3, the low temperature melting furnace 100 using the external cooling passage, the metal sector 200, and the extension tube 300 are standardized and modularized in a factory beforehand, thereby improving work efficiency at a work site.

The metal sector 200 has one end portion connected to the first extension tube 310 of the extension tube 300 is connected, wherein the first extension tube 310 is inserted to the cooling passage 210 of the metal sector 200.

Similar to a connection relationship of the first extension tube 310, the second extension tube 320 of the extension tube 300 is connected to the other end portion of the metal sector 200, wherein the second extension tube 320 is inserted to the cooling passage 210 of the metal sector 200.

The metal sector 200 is supported by the support unit 400 having a plate shape and each metal sector 200 is provided at a lower portion of the support unit 400.

The insulation material 500 fills between the metal sectors 200, each of which is supported by the support unit 400.

As shown in FIG. 4, when the first extension tube 310 and the second extension tube 320 are connected to the metal sector 200, the cooling water is supplied to the inlet 311 of the first extension tube 310, which is connected to a separate cooling water supplying apparatus.

The cooling water supplied through the inlet 311 is provided to the first cooling passage 312 of the first extension tube 310 to flow to the cooling passage 210 of the metal sector 200 connected to the first cooling passage 312.

The cooling water supplied from the first extension tube 310 is provided to the second extension tube 320 through the cooing passage 210.

The cooling water supplied from the cooling passage 210 flows to the second cooling passage 322 of the extension tube 320 to be discharged outside through the outlet 321.

According to the present invention, only one cooling passage is formed in each metal sector and the extension tube positioned outwardly from the wall of the low temperature melting furnace is connected to the cooling passage of each metal sector so that the metal sector may have a small size. Thus, the number of the metal sector that can be installed in the low temperature melting furnace having a predefined size may be increased, thereby improving energy efficiency.

Also, the cooling passage formed in each metal sector may have a straight line shape rather than a curve shape, which is disadvantageous for a cooling water flow, thereby improving the cooling water flow while preventing a foreign material from accumulating in the cooling passage.

In the above, although the embodiments of the present invention have been described with reference to the accompanying drawings, a person skilled in the art should apprehend that the present invention can be embodied in other specific forms without departing from the technical spirit or essential characteristics thereof. Thus, the embodiments described above should be construed as exemplary in every aspect and not limiting.

What is claimed is:

1. A low temperature melting furnace using an external cooling passage, the low temperature melting furnace comprising:

a wall comprising a plurality of side-by-side metal sectors, each metal sector having an upper end portion, a lower end portion and a cooling passage formed therein, the cooling passage extending straight between the upper end portion and the lower end portion of the metal sector;

a plurality of first extension tubes placed outside the wall, each first extension tube corresponding to a different one of the metal sectors and including a first connection portion extending outwardly from the upper end portion of the corresponding metal sector, a first parallel portion extending in parallel to the corresponding metal sector from the first connection portion towards the lower end portion of the corresponding metal sector, and an inlet extending from an end of the first parallel portion; and a plurality of second extension tubes, each second extension tube corresponding to a different one of the metal sectors and including a second connection portion extending outwardly from the lower end portion of the corresponding metal sector, a second parallel portion extending in parallel to the corresponding metal sector from an end of the second connection portion towards an opposite direction of the upper end portion of the corresponding metal sector, and an outlet extending from the second parallel portion.

2. The low temperature melting furnace according to claim 1, wherein each metal sector further includes a support unit having a plate shape, the support unit supporting the metal sector from a bottom.

3. The low temperature melting furnace according to claim 1, wherein the numbers of metal sectors and first extension tubes are equal.

4. The low temperature melting furnace according to claim 1, further comprising an insulation material between adjacent spaces of the metal sectors.

5. A metal sector unit of a low temperature melting furnace, the metal sector unit comprising:

a metal sector having an upper end portion, a lower end portion and a cooling passage formed therein, the cooling passage extending straight between the upper end portion and the lower end portion of the metal sector;

a first extension tube including a first connection portion extending outwardly from the upper end portion of the metal sector, a first parallel portion extending in parallel with the metal sector from the first connection portion towards the lower end portion of the metal sector, and an inlet extending from an end of the first parallel portion; and a second extension tube including a second connection portion extending outwardly from the lower end portion of the metal sector, a second parallel portion extending in parallel to the metal sector from an end of the second connection portion towards an opposite direction of the upper end portion of the metal sector, and an outlet extending from the second parallel portion.

* * * * *